US005477711A

United States Patent [19]

Oliveri

[11] Patent Number: 5,477,711

[45] Date of Patent: Dec. 26, 1995

[54] OPENING OCCLUDING LOCK ASSEMBLY

[76] Inventor: George Oliveri, 2280 Highfield Ct., Aurora, Ill. 60504

[21] Appl. No.: 134,596

[22] Filed: Oct. 12, 1993

[51] Int. Cl.[6] ..... E05B 9/04

[52] U.S. Cl. ..... 70/369; 70/259; 70/370; 70/371; 70/452

[58] Field of Search ..... 70/163, 166, 367–371, 70/451, 452, 421, 259, 260, 373, 374, DIG. 62, 229–232

[56] References Cited

U.S. PATENT DOCUMENTS

| | | | |
|---|---|---|---|
| 1,010,727 | 12/1911 | Corbin et al. | 70/DIG. 62 X |
| 1,487,900 | 3/1924 | Teich | 70/DIG 62 X |
| 1,705,590 | 3/1929 | Simpson | 70/260 |
| 1,787,591 | 1/1931 | Ottinger | 292/DIG. 27 X |
| 1,805,779 | 5/1931 | Metz et al. | 70/259 |
| 1,908,672 | 5/1933 | Jacobi | 70/369 |
| 2,008,668 | 7/1935 | Gold | 70/368 |
| 3,817,065 | 6/1974 | Sander | 70/371 X |
| 4,630,457 | 12/1986 | Kincaid et al. | 70/369 |
| 5,077,995 | 1/1992 | Appelbaum | 70/259 |
| 5,332,251 | 7/1994 | Farquhar | 70/14 X |

FOREIGN PATENT DOCUMENTS

| | | | |
|---|---|---|---|
| 2227787 | 8/1990 | United Kingdom | 70/370 |

*Primary Examiner*—Lloyd A. Gall
*Attorney, Agent, or Firm*—Basil E. Demeur; Alan B. Samlan

[57] ABSTRACT

A key operated lock assembly for blocking access to an opening in a static wall structure. The lock assembly is formed by a lock sleeve adapted for positioning behind the opening adjacent the rear wall of the static wall structure, wherein the lock sleeve has a tubular sleeve member extending rearwardly therefrom. The forward end of the lock sleeve is provided with a dome-shaped head portion which is formed integrally with the sleeve. A lock plug is provided having a front end and a rear end and sized for insertion through the opening in the static wall structure and into the sleeve member of the lock sleeve positioned adjacent the rear wall of the structure. The lock plug is also provided with lock pin elements which cooperate with pin detents formed at the back end of the lock sleeve which cooperate to lockingly engage the lock plug to the lock sleeve with the static wall structure interposed therebetween in order to block access through the opening in the static wall structure.

7 Claims, 2 Drawing Sheets

OPENING OCCLUDING LOCK ASSEMBLY

BACKGROUND OF THE INVENTION

The present invention relates to a lock assembly adapted for a particular use, that being the ability to occlude or block access to an opening in the static wall structure.

There are several applications wherein openings are inserted or provided in static wall structures in order to permit access to be had to a mechanism or other structure on the rear wall side of a static wall structure. For example, various mechanical and/or electronic components may have an opening formed in a wall member of a housing, the opening intended to give access to service personnel by means of the insertion of a screw driver or other appropriate tool in order to open the housing. More specifically, and in accordance with the present invention, it is well-known that many of the current vehicles such as trucks and other heavy duty equipment are provided with spare tire assemblies which are mounted under the vehicle adjacent the rear bumper. Such spare tires are usually carried in a mechanism which is designed to lower the spare tire when needed, the tire being lowered by means of applying a tool through an opening in the bumper in order to engage a pulley assembly and permitting the operator to rotate the tool such as a tire jack handle and as one rotates the handle, the pulley assembly is activated to lower the tire. In this particular application, any person, whether authorized or not, has access to the pulley assembly by merely inserting a tool through an opening in the bumper. This has caused a virtual epidemic in the theft of spare tires from truck vehicles especially in view of the fact that such equipment is quite valuable, and expensive to replace. Indeed, it has been estimated that there are several millions of dollars worth of tires stolen from new and used vehicles due to the access which is available to the spare tire assembly through the opening provided in the bumper.

One of the difficulties that has been noted with respect to designing any lock assembly for occluding the opening has been the fact that different manufacturers make different sized holes in the bumper, and it has been difficult to develop a lock assembly which would have a universal fitting regardless of the size of the opening in the bumper. Another difficulty in developing a lock assembly which would have a universal fitting with respect to a bumper is the fact that the openings in some bumpers are located along a curved surface. Hence, the lock not only must be designed to fit any sized opening as indicated, but it should be able to be adaptable to even a curved wall structure. For these reasons, lock assemblies have not been developed for such specific application. As a result, the loss of spare tires due to theft has been on the rise.

While the present specification references a lock assembly for use especially in connection with occluding the access opening for spare tires on motor vehicles, it will be appreciated that the lock assembly of the present invention is actually designed to be useful for occluding any opening in a static wall structure for access to both sides of the wall are available to the user. However, the following specification shall make reference to the specific use in connection with the openings located in bumpers which provide access to the spare tire assembly for ease of description.

OBJECTS AND ADVANTAGES

It is therefore the principal object of the present invention to provide a lock assembly which is specifically intended to permit the user to occlude access to an opening in a static wall structure for preventing access to a mechanism located on the rear wall side of the static wall structure.

In connection with the foregoing object, it is an object of the present invention to provide a key operated lock assembly for blocking access to an opening in a static wall structure which includes a lock sleeve adapted for positioning behind the opening adjacent the rear wall of the static wall structure, the lock sleeve having a tubular sleeve member extending rearwardly therefrom, a lock plug having a front end and a rear end and sized for insertion through the opening in the static wall structure and into the sleeve member of the lock sleeve positioned adjacent the rear wall of the static wall structure, the lock plug and lock sleeve provided with cooperating locking means for lockingly engaging the lock plug to the lock sleeve with the static wall structure interposed therebetween, such that when lockingly engaging the lock plug to the lock sleeve, access through the opening is totally occluded unless the lock assembly is removed therefrom.

In conjunction with the foregoing object, it is a further object of the present invention to provide a lock assembly of the type described wherein the lock sleeve is formed with a dome-shaped head forming the head portion of the lock sleeve, and having a tubular sleeve member formed integrally therewith extending rearwardly therefrom, the dome-shaped head provided with a lock plug opening centrally positioned therein and in horizontal alignment with the tubular sleeve member, the dome-shaped head being adapted for positioning against the rear wall of the static wall structure with the lock plug opening therein being in horizontal alignment with the opening and the static wall structure. The dome shape of the head permits the lock sleeve to be positioned against any size opening in a static wall structure, and in addition, the dome-shaped configuration of the head permits the lock to be positioned in an opening which is located along a curved surface, and still permits the occluding of the opening when the lock plug is lockingly engaged therein.

A further object of the present invention is to provide a lock assembly of the type described, wherein the lock assembly is further provided with a lock plug washer having a central lock plug aperture formed therein and the aperture surrounded by a head recess, and wherein the lock plug is provided with a plug head at the forward end thereof which forms a seatment flange, the seatment flange being adapted for seatment in the head recess, such that when the lock plug washer is in place, the lock washer will be interposed and surround the opening in the static wall structure adjacent the front wall end thereof with the lock plug inserted therethrough, and the dome-shaped head portion of the lock sleeve will be positioned against the opening adjacent the rear wall side of the static wall structure, whether on a flat or curved surface such that any size opening will be accommodated by the lock assembly and be fully occluded by means of the lock washer on the front wall side of the static wall structure and the dome-shaped head portion of the lock sleeve on the rear wall portion of the static wall structure.

A further object of the present invention, in conjunction with the foregoing objects, is to provide a lock assembly of the type described, wherein the lock plug is provided with a lock pin carried at the rear end portion of the lock plug, and the lock sleeve is provided with a pair of lock pin detents formed at the rear end wall portion of the lock sleeve, the pin detents being positioned such that the lock pin elements of the lock plug, when inserted through the lock sleeve, may be rotated until they engage in the pin detents in order to lockingly engage the lock plug to the lock sleeve.

In conjunction with the foregoing object, a further object is to permit the lock assembly to be compressed against the opening in the bumper structure by means of the cammed surface of the rear end of the lock sleeve member operating in conjunction with the lock pins which are rotated thereon in order to lockingly engage into the pin detents such that the two lock elements are compressed together via the compression washer positioned therebetween.

Further features and objects of the present invention will be better understood by reference to the following specification taken in conjunction with the accompanying drawings.

SUMMARY OF THE INVENTION

In summary, the present invention provides a lock assembly which is intended for the specific purpose of permitting the occlusion of an opening in a static wall structure regardless of the sizing of the opening, or the curvature of the static wall structure. The lock assembly of the present invention provides a rear piece consisting of a lock sleeve having a dome-shaped head portion intended for positioning against the opening in the static wall structure adjacent the rear wall portion thereof, and a lock plug which is intended for insertion through the opening in the static wall structure from the front wall side portion thereof, the lock plug being insertable into the lock sleeve portion with the static wall structure interposed therebetween, and having locking means for lockingly engaging the plug to the sleeve thereby fully occluding and blocking access through the opening in the static wall structure when the lock is lockingly positioned in place.

The present invention further provides a lock assembly of the type described which may further include, in the ideal situation, a lock plug washer which cooperates with the lock plug along the front wall portion of the static wall structure such that the washer will insure that the opening in the static wall structure is fully occluded from the front side, while the dome-shaped head portion of the lock sleeve on the rear side of the opening insures that the opening is fully occluded from the rear side of the static wall structure.

The following detailed description fully explains the operational features of the invention as well as the various parts and elements forming the subject matter of the present invention.

DETAILED DESCRIPTION OF DRAWINGS

Figure 1:
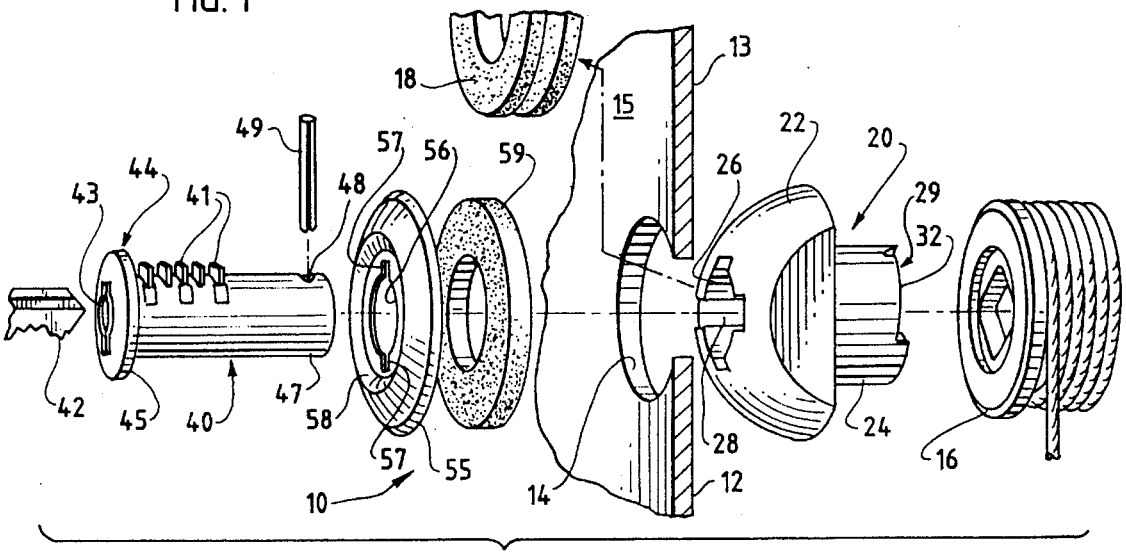
FIG. 1 is an exploded perspective view, partly in cross-section, showing the arrangement of the lock assembly in conjunction with a static wall structure in accordance with the present invention.

FIG. 1 aptly shows the lock assembly of the present invention in a perspective exploded view. By way of background and explanation, and as has been indicated hereinbefore, in the new truck vehicles which are presently produced, the spare tire assemblies are typically located under the rear portion of the vehicle and held in position by means of a pulley arrangement. When the user is required to obtain access to the spare tire, an opening is provided in the rear bumper of the vehicle to give the user access to the spare tire assembly.

Typically, the opening provided in the rear bumper is surrounded by a flexible gasket which is primarily intended to prevent the operator from scratching the bumper surface when manipulating a tool during the spare tire removal process. As will be described hereinafter, the rubber gasket provided by the manufacturer is removed incident to the installation of the lock assembly of the present invention.

Further, it will become apparent from the following description that the opening provided in the bumper with different manufacturers may be a differently sized opening, or bumpers which are curved rather than flat and planar. It is for this reason that the provision of a lock assembly which has universal application to all makes and models of trucks or other vehicles having the same type of spare tire assembly has posed a problem in the field. The present invention is intended to obviate such a problem.

With specific reference to FIG. 1 of the drawings, the lock assembly, generally referred to by the numeral 10 is illustrated in exploded fashion in conjunction with a static wall structure such as a bumper having an opening therein. It will be observed that the lock assembly 10 of the present invention is specifically intended to operate in conjunction with a static wall structure 12 which contains an opening 14 which, again, is provided for a specific purpose. As shown in the drawings herein, static wall structure 12 may be a bumper on a motor vehicle, and the opening 14 is provided in order to provide access to a pulley arrangement 16 which operates an assembly for lowering a spare tire from the underside of the vehicle. As previously described, in the typical operation, the operator would apply a jack handle or other tool through the opening 14 in the bumper 12, until it engages the pulley assembly 16, and then rotates the tool in order to manipulate the pulley assembly 16 and lower the tire. The lock assembly 10 of the present invention is intended to permit the operator to occlude the opening 14 unless and until the operator is ready to utilize the spare tire assembly.

The lock assembly 10 is formed by means of a rear portion consisting of a lock sleeve 20 formed by a forward dome-shaped head 22 and a lock sleeve member 24 formed integrally therewith. The lock sleeve member 24 is tubular in configuration and is shown to extend in a horizontal plane rearwardly from the dome-shaped head 22.

The dome-shaped head 22 is provided with a lock plug opening 26 centrally positioned therein, and is in horizontal alignment with the tubular sleeve member 24. Hence, the central opening 26 is in alignment with the opening forming the interior of the tubular lock sleeve member 24.

Figure 4:
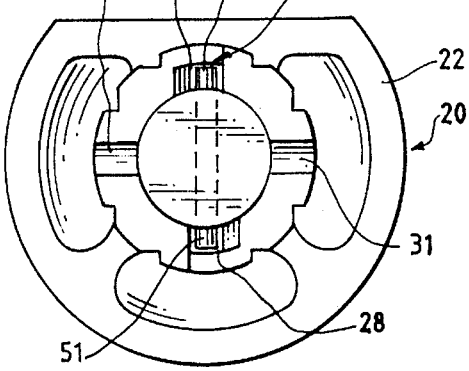
FIG. 4 is a rear elevational view showing the lock plug as inserted into the lock sleeve prior to the locking operation.

It will also be observed from FIGS. 1 and 4 of the drawings, that the lock sleeve member 24 is provided with a pair of longitudinal pin slots 28 running along the horizontal length of the lock sleeve member 24. The lock sleeve member 24 terminates at a rear end 29 which further includes a pair of pin detents 31 which are positioned 90 degrees away from the longitudinal pin slots 28 which run along the longitudinal length of the lock sleeve member 24 terminating at the rear end thereof. This particular orientation is more particularly shown in FIGS. 4 and 6 of the drawings. Further, the rear end 29 of lock sleeve member 24 is ideally provided with a cammed surface 32 running between the end points of the longitudinal pin slots 28, and the pin detents 31.

Figure 3:
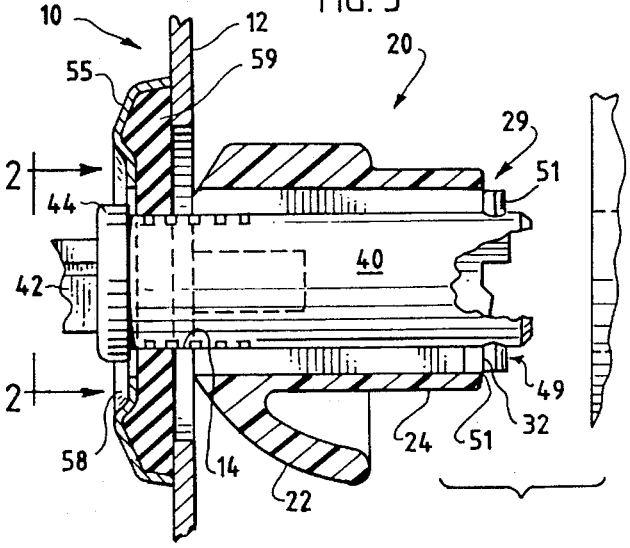
FIG. 3 is a side elevational view, in cross-section, showing the manner in which the lock plug is inserted through the lock washer, through the opening to be occluded in the static wall structure, and into the lock sleeve portion of the lock assembly in the unlocked position.

As is observed in FIGS. 1 and 3 of the drawings, the lock sleeve 20 is intended for positioning against the opening 14 in the static wall structure 12 by simply positioning the dome-shaped head 22 thereof against the opening 14. It will be appreciated from this construction, that the opening 14 may be sized differently, but due to the configuration of the dome-shaped head 22, the opening 14 will be occluded by the lock sleeve 20 when positioned against the rear wall 13 as particularly shown in FIG. 3.

The front portion of the lock assembly 10 is formed by a lock plug 40 which is formed similar to other lock plugs well-known in the art. The lock plug 40 includes a plurality of tumblers 41 mounted in the body of the lock plug 40, and operated by means of a key 42 which is inserted into the lock plug 40 through keyway 43. It will be noted that the front end of the lock plug 40 includes a plug head 44 which actually forms a seatment flange 45.

Figure 2:
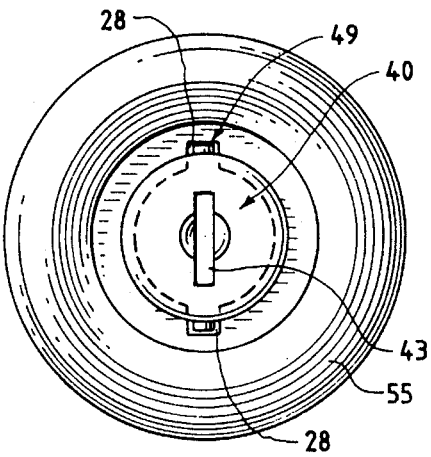
FIG. 2 is a front elevational view showing the lock plug of the lock assembly as inserted through the lock washer and into the opening contained in the static wall structure.

The rear end 47 of the lock plug 40 has an aperture 48 provided therethrough which carries the lock pin 49 therein. The lock pin 49 is fixedly secured within the aperture 48 and this may be accomplished by providing a knurled pin 49 which is forcibly driven into the aperture 48 in a manner well-known in the art. It will also be appreciated from a view of FIGS. 2 through 6 of the drawings, that once the lock pin 49 is driven into the aperture 48, a pair of opposed pin elements 51 extend outwardly from the lock plug 40 for a short distance and in opposed relationship one to the other (see FIGS. 2 and 4).

It will be appreciated from the description at this point, that in order to insert the lock plug 40 into the lock sleeve 20, the pin elements 51 must ride in the longitudinal pin slots 28 formed along the interior surface of the lock sleeve member 24. Once the lock plug 40 has been fully inserted into the lock sleeve member 24, the pin elements 51 will override and lie along the rear end 29 of the lock sleeve member 24 (see FIG. 3).

In FIG. 1, it is briefly illustrated that incident to the installation of the lock assembly 10 of the present invention, the rubber gasket 18 provided by the manufacture in the opening 14 is removed, which will permit the operator or user to fit the lock assembly 10 of the present invention to the opening 14 in a snug fashion.

As illustrated further in FIGS. 1 and 3 of the drawings, in the ideal embodiment of the invention, a lock plug washer 55 is provided which is also provided with a central opening 56 and contains a pair of pin cutouts 57 as a part of the opening 56. A cushioning gasket 59 is provided which, in use, lays between the lock plug washer 55, and the front wall 15 of the static wall structure 12 in surrounding relationship relative to the opening 14.

The lock plug washer 55 is provided primarily to make sure that regardless of the sizing of the opening 14 in the static wall structure 12, the front of the opening 14 will be occluded once the lock plug 40 is inserted therethrough and into the lock sleeve member 24, the completed assembly being shown in FIG. 3 of the drawings. The lock plug washer 55 may be variously sized and variable in order to accommodate any differently sized opening 14 given that different manufacturers may make the opening 14 larger or smaller than other manufacturers. Hence, the particular size of the lock plug washer 55 may be variable, and may be provided in different sizes for the user.

From a view of both FIGS. 1 and 3 of the drawings, it will also be observed that the lock plug washer 55 is provided with a head recess 58 which accommodates the seatment therein of the seatment flange 45 formed by the plug head 44. Once again, as shown in FIG. 3 of the drawings, it will be observed that the cushioning gasket 59 lays against the front wall 15 of the static wall structure 12, and is overlaid by the lock plug washer 55. The lock plug 40 is then inserted through the various central openings, namely opening 56, 14, and into the lock plug opening 26 until the rear end 47 of the lock plug 40 meets adjacent the rear end 29 of the lock sleeve 20. In this position, the lock pin elements 51 override the rear end 29 of the lock sleeve 20 along the cam surface 32.

Figure 5:
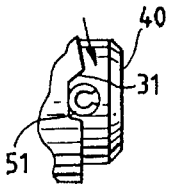
FIG. 5 is a broken away side elevational view showing the lock pin elements of the lock plug as positioned in the lock pin detent at the back side of the lock sleeve in the locking position.
Figure 6:
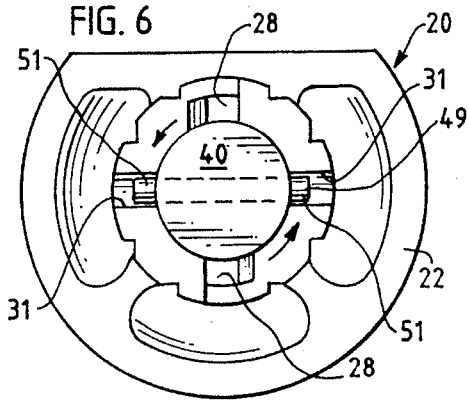
FIG. 6 is a rear elevational view showing the lock plug in position in the lock sleeve with the lock pin elements in the locking position in the pin detents located in the rear end of the lock sleeve.

It will therefore be appreciated that once the key 42 is inserted into the keyway 43, and the lock tumblers 41 manipulated, the lock plug 40 will be rotated 90 degrees. Incident to the rotation process, the pin elements 51 of the lock pin 49 will rotate 90 degrees, and will ride along the cam surface 32 of the rear end 29 of the sleeve member 24 until they ride into and are retained in the pin detents 31. The locking feature is shown in FIGS. 5 and 6 of the drawings. Once the lock plug 40 is locked into the lock sleeve 20, the opening 14 contained in the static wall structure 12 is fully occluded and access to the pulley assembly 16 which contains the spare tire removal mechanism is occluded.

It will also be appreciated from the above description that as the lock plug 40 is rotated 90 degrees in order to ride the pin elements 51 into the pin detents 31, the pin elements 51 will ride along the cam surface 32 of the rear end 29 of the sleeve member 24. The function of the cam surface 32 is to cause the respective lock plug 40 and lock sleeve 20 to snug together, in order to effect a tight fit. The cushioning gasket 59 is formed of a rubberized material, and will therefore take up the pressure caused by the snugging of the lock plug 40 relative to the lock sleeve 20 as the pin elements 51 ride along the cam surface 32.

It will be appreciated that in order to install and remove the lock assembly 10 of the present invention, the operator would merely grasp the lock sleeve 20 and position it over the opening 14 adjacent the rear wall 13 of the bumper or static wall structure 12. The operator would hold the lock sleeve in position with one hand, and would then insert the lock plug with a key 42 in the keyway 43 in position through the opening 14 and into the lock plug opening 26 of the lock sleeve 20. The tumblers 41 of the lock plug 40 interact with the lock sleeve 20 in a manner well-known in the lock art with respect to removable core locks. Once the two parts have been inserted through the opening, the operator need only turn the key 42 in the keyway 43 in order to rotate the lock plug 40, 90 degrees. As indicated, the rotational movement will cause the pin elements 51 to ride along the cam surface 32 at the rear end 29 of the lock sleeve member 24 until they ride into the pin detents 31. Hence, the two lock members are now locked together and the opening 14 is totally occluded. Access can only be gained to the opening by removing the lock assembly by reversing the above indicated process.

From the above description, it will also become clear, and as previously indicated, that as a result of the use of a dome-shaped head 22 on the lock sleeve 20, as well as the use of an enlarged lock plug washer 55 used in conjunction with the lock plug 40, the particular diametric sizing of the opening 14 is irrelevant to the operational features of the lock assembly 10. Hence, regardless of the size of the opening as may be created by the manufacture of the vehicle, the lock assembly 10 of the present invention may be used to occlude the opening and hence prevent unauthorized removal of the spare tire assembly. As was previously mentioned, and as will be appreciated from the above description, that the use of a dome-shaped head 22 on the lock sleeve 20 also permits the lock assembly 10 of the present invention to be used on either a convex or concave configured surface in the event that a particular manufacturer's bumper would be curved in either manner.

Figure 7:
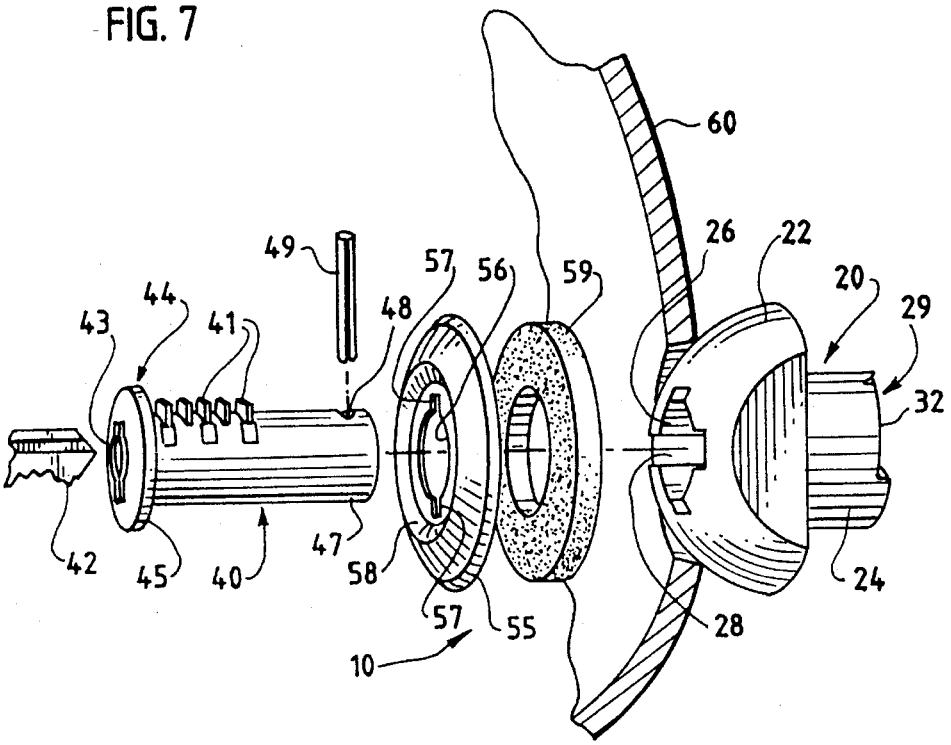
FIG. 7 is an exploded perspective view, partly in cross-section, showing the arrangement of the lock assembly in conjunction with a static wall structure which is curved in configuration in accordance with the present invention.

FIG. 7 of the drawing illustrates the use of the lock assembly 10 of the present invention as applied to a convexly curved bumper 60 and illustrates the manner in which the dome-shaped head 22 will fit within the opening 62 and still permit a snug fit of the lock plug washer 55 as the lock plug 40 is inserted into the lock sleeve member 24.

Figure 9:
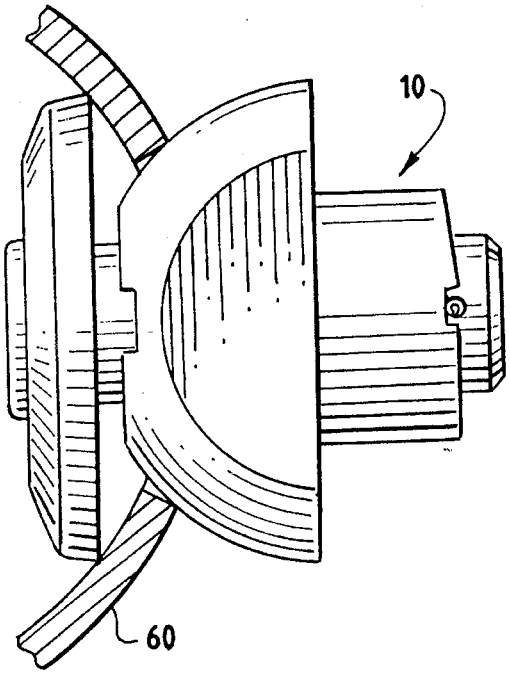
FIG. 9 is a side elevational view, in cross-section, schematically illustrating the lock assembly of the present invention as inserted through a convexly curved wall structure.

FIG. 9 is a schematic cross-sectional view of this configuration, once again showing the lock assembly 10 as inserted into a convexly curved static wall structure such as a bumper 60.

Figure 8:
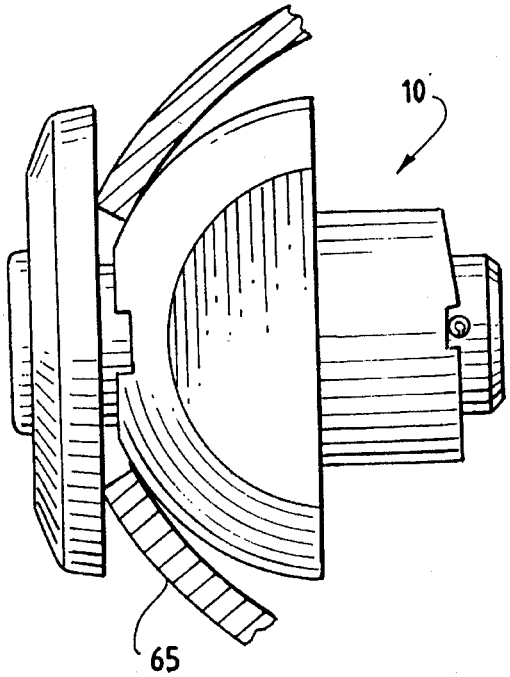
FIG. 8 is a side elevational view, in cross-section schematically illustrating the lock of the present invention as inserted into a concavely curved bumper element.

FIG. 8 illustrates that the lock assembly of the present invention may similarly be used in connection with a concavely curved static wall structure 12 such as a bumper 65, and shows the lock assembly 10 inserted through the opening therein.

Hence, as indicated, the lock assembly 10 of the present invention is universally adapted for insertion in an opening in any static wall structure, regardless of the size of the opening, within given parameters, and regardless of the convexity or concavity of the static wall structure. For this reason, the lock assembly 10 of the present invention has universal application in connection with occluding openings and bumpers of the type which are designed for the insertion of a tool for lowering a spare tire and preventing the unauthorized removal therefrom.

As was previously indicated, while the present description of the invention makes specific reference to the use of the lock assembly 10 in conjunction with occluding the opening 14 in a static wall structure 12 consisting of a truck bumper, in order to prevent unauthorized access to the spare tire pulley assembly 16, it will be appreciated that the lock assembly 10 of the present invention is similarly useful in connection with any structure wherein it is intended to occlude an opening in order to prevent unauthorized access to a structure located to the interior portion of a mechanism or housing. Further, the particular size of the lock assembly is not considered pertinent to the present invention since the lock assembly herein may be made in any different sizing arrangement as application indicates.

In terms of materials, it is contemplated that the lock assembly herein may be made of a cast metal, brass, or any other metallic elements used for the production of locks. Clearly, it would be indicated not to utilize plastics since a plastic lock assembly could be easily fractured by an unauthorized person simply by using a chisel and mallet. However, the particular materials from which the parts and mechanisms of the present invention are produced is similarly not deemed critical to the invention or to the inventive subject matter herein.

From the above description, it will be appreciated that the present invention provides an easy-to-use lock assembly for the purpose of occluding openings wherein access to a structure through the opening is intended to be prevented. The present invention is easily installed regardless of the size opening, and in its intended useful application, basically consists of a two-part lock assembly, consisting of the lock plug as the forward portion, and the plug receiving lock sleeve as the rear portion.

While there has been described what is at present considered to be the preferred embodiment of the invention, it will be understood that the present application is intended to cover in the appended claims all obvious variations and modifications of the present invention.

I claim:

1. A key operated lock assembly for blocking access to an opening in a static wall structure having a front wall portion and a rear wall portion, comprising in combination, a lock sleeve adapted for positioning behind the opening adjacent the rear wall portion of the static wall structure, said lock sleeve provided with a dome-shaped head forming the head portion of said lock sleeve and having a tubular sleeve member formed integrally therewith and extending rearwardly therefrom and terminating in a rear end, said dome-shaped head further provided with a lock plug opening centrally positioned therein and in horizontal alignment with said tubular sleeve member, said dome-shaped head being adapted for positioning against the rear wall portion of the static wall structure with said lock plug opening being in horizontal alignment with said opening in the static wall structure, a lock plug having a front end and a rear end and sized for insertion through the opening in the static wall structure adjacent the front wall portion thereof and into said sleeve member of said lock sleeve positioned adjacent the rear wall portion of the static wall structure, said lock plug including a key way formed therein and a plurality of lock tumblers mounted therein such that said lock plug is operable with an appropriate key inserted through said key way, said lock plug and lock sleeve provided with cooperating locking means for lockingly engaging said lock plug to said lock sleeve with the static wall structure interposed therebetween, whereby said lock assembly blocks access through the opening in the static wall structure when said lock plug is inserted into the opening in the static wall structure from the front wall side thereof and into said lock sleeve positioned behind the static wall structure and lockingly engaged therein.

2. The lock assembly as set forth in claim 1 above, wherein said locking means for lockingly engaging said lock plug to said lock sleeve comprises, a lock pin mounted on said lock plug adjacent the rear end thereof and having lock pin elements extending outwardly from said lock plug a short distance and in opposed relation one to the other, said lock sleeve provided with a pair of opposed longitudinal pin slots extending along the horizontal length of said sleeve member and further provided with a pair of pin detents formed in the rear end, said pin detents being positioned 90 degrees away from the horizontal plane of said longitudinal pin slots in said sleeve member, said lock pin elements being sized for insertion into and through said longitudinal pin slots in said lock sleeve and sized to override said rear end of said lock sleeve, whereby upon insertion of said lock pin elements through said longitudinal pin slots and into an override position relative to said rear end of said lock sleeve, said lock plug may be manipulated by an appropriate key and rotated 90 degrees thereby to cause said pin elements to ride into and engage with said pin detents thereby to lockingly engage said lock plug to said lock sleeve.

3. The lock assembly as set forth in claim 3 above, wherein said rear end of said lock sleeve is provided with a cammed surface, said surface being cammed between said longitudinal pin slots and said pin detents.

4. A key operated lock assembly for blocking access to an opening in a static wall structure having a front wall and a rear wall, comprising in combination, a lock sleeve adapted for positioning behind the opening adjacent the rear wall of the static wall structure, said lock sleeve formed by a forward dome-shaped head and having a tubular sleeve member formed integrally therewith and extending rearwardly therefrom and terminating in a rear end, said dome-shaped head provided with a lock plug opening centrally positioned therein and in horizontal alignment with said tubular sleeve member, a lock plug having a front end and a rear end and sized for insertion through the opening in the static wall structure and into and through said tubular sleeve member of said lock sleeve, said lock plug including a keyway formed in the front end thereof and a plurality of lock tumblers mounted therein such that said lock plug is operable with an appropriate key inserted through said keyway, said dome-shaped head of said lock sleeve being adapted for positioning adjacent the rear wall of the static wall structure with said lock plug opening in said dome-shaped head being in horizontal alignment with the opening in the static wall structure, and said lock plug being adapted for insertion through the opening of the static wall structure and into the sleeve member of said lock sleeve, said lock plug and lock sleeve provided with cooperating lock means for lockingly engaging said lock plug to said lock sleeve with the static wall structure interposed therebetween, whereby upon the locking engagement of said lock plug with said lock sleeve through the opening in the static wall structure, access to the opening in the static wall structure is occluded.

5. The lock assembly as set forth in claim 4 above, wherein said lock means for lockingly engaging said lock plug to said lock sleeve comprises, a lock pin mounted on said lock plug adjacent the rear end thereof and having lock pin elements extending outwardly from said lock plug a short distance and in opposed relation one to the other, said lock sleeve provided with a pair of opposed longitudinal pin slots extending along the horizontal length of said sleeve member, and further provided with a pair of pin detents formed in the rear end thereof, said pin detents being positioned 90 degrees away from the horizontal plane of said longitudinal pin slots in said sleeve member, said lock pin elements being sized for insertion into and through said longitudinal pin slots in said lock sleeve and sized to override said rear end thereof, whereby upon insertion of said lock pin elements through said longitudinal pin slots and into an override position relative to said rear end of said lock sleeve, said lock plug may be manipulated by an appropriate key and rotated 90 degrees thereby to cause said pin elements to ride into and engage with said pin detents thereby to lockingly engage said lock plug to said lock sleeve.

6. The lock assembly as set forth in claim 5 above, wherein said rear end of said lock sleeve is provided with a cammed surface, said surface being cammed between said longitudinal pin slots and said pin detents.

7. The lock assembly as set forth in claim 6 above, wherein said lock assembly is further provided with a lock plug washer having a central lock plug aperture formed therein and said central lock plug aperture surrounded by a lock head recess, and said lock plug is further provided with a plug head at the front end thereof forming a seatment flange, said seatment flange adapted for seatment in said head recess, whereby said lock plug washer is adapted to receive said lock plug therethrough with said seatment flange seated in said head recess, said lock plug washer overlies the opening in the static wall structure thereby to insure that the opening in the static wall structure is fully occluded to access when said lock plug is lockingly engaged to said lock sleeve.

* * * * *